US006547513B1

(12) United States Patent
Hummel et al.

(10) Patent No.: US 6,547,513 B1
(45) **Date of Patent: *Apr. 15, 2003**

(54) STACK CHANGING DEVICE

(75) Inventors: Peter Hummel, Offenbach (DE); Robert Ortner, Alzenau (DE); Jens Gebel, Seligenstadt (DE); Marc Hinz, Rodenbach (DE); Bernd Ullrich, Kahl/Main (DE); Uwe Basel, Offenbach (DE); Harald Wolski, Rodgau (DE)

(73) Assignee: Man Roland Druckmaschinen AG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/367,131

(22) PCT Filed: Feb. 3, 1998

(86) PCT No.: PCT/EP98/00567

§ 371 (c)(1),
(2), (4) Date: Aug. 5, 1999

(87) PCT Pub. No.: WO98/34864

PCT Pub. Date: Aug. 13, 1998

(30) Foreign Application Priority Data

Feb. 5, 1997 (DE) ..... 197 04 285

(51) Int. Cl.[7] ..... B65H 1/26

(52) U.S. Cl. ..... 414/795.8; 271/158; 271/159

(58) Field of Search ..... 271/157, 158, 271/159; 414/795.8

(56) References Cited

U.S. PATENT DOCUMENTS

| | | | | | |
|---|---|---|---|---|---|
| 2,690,337 | A | * | 9/1954 | Halahan et al. | 271/159 |
| 4,021,710 | A | * | 5/1977 | Fichte et al. | 271/159 X |
| 4,174,831 | A | * | 11/1979 | Marass et al. | 271/159 |
| 5,011,126 | A | * | 4/1991 | Suzuki et al. | 271/159 X |
| 5,295,681 | A | * | 3/1994 | Blaser | 271/159 X |
| 5,405,130 | A | * | 4/1995 | Maas | 271/159 X |
| 5,538,238 | A | * | 7/1996 | Filsinger | 271/159 |
| 5,803,446 | A | * | 9/1998 | Leuthold et al. | 271/159 X |

FOREIGN PATENT DOCUMENTS

| | | | | |
|---|---|---|---|---|
| DE | 11 10 659 | B | 7/1961 | |
| DE | 26 37 086 | * | 12/1977 | 271/159 |
| DE | 39 31 710 | A | 4/1990 | |
| DE | 42 03 500 | A | 8/1993 | |
| DE | 195 20 772 | C | 10/1996 | |
| EP | 0 604 770 | A | 7/1994 | |

* cited by examiner

*Primary Examiner*—Janice L. Krizek
(74) *Attorney, Agent, or Firm*—Leydig, Voit & Mayer, Ltd.

(57) ABSTRACT

In a stack changing device, on a sheet feeder the remaining stack bars (7A, 7B) are pulled from the stack area, out-of-line in relation to each other. For improved stack joining, the inner remaining stack bars (7A, 7B) are each pulled more slowly than the outer remaining stack bars (7A, 7B).

18 Claims, 5 Drawing Sheets

STACK CHANGING DEVICE

FIELD OF THE INVENTION

The present invention relates to sheet-fed printing machines and, more particularly to an improved stack changing device for sheet feeders of sheet-fed printing machines.

BACKGROUND OF THE INVENTION

It is a known practice, in sheet feeders of sheet-fed printing presses, to provide arrangements for automated stack change. These can consist of rack-type structures, so-called remaining stack carrying devices, which are provided with thrust and lift drives for the horizontal and vertical movement. Such so-called non-stop stack changers are suited, during the printing of paper sheets, for example in machine running, to remove the remaining of used-up sheet stacks from a pallet, provided for example with grooves and to deposit them again on a new sheet stack subsequently installed in the sheet feeder. Known devices are distinguished by a great expenditure in construction and assembly, and require special constructions of the sheet feeders. Further, here devices are used, the remaining stack carrying device of which requires a rake engaging into the grooves of the pallet. This rake has to be removed in the joining of the remaining stack with the newly installed sheet stack as a whole between the two stack parts. This involves high drive forces and places very strong stresses on the sheets lying next to the section point.

Furthermore, restraining means are to be provided which prevent a shifting of the stack parts, and, in the process, severely stress the stack edges. Furthermore, the operation of the sheet feeder itself is severely hindered or even made impossible. The sheet flow is difficult to control in the changing operation, so that wasted sheets result again and again.

There have already been developed devices which partly avoid some of the disadvantages described.

Thus, from DE 393 1710 C2 there is known a non-stop sheet feeder for sheet-fed rotary presses. It has a remaining-stack carrying device which is arranged underneath a band table leading from the sheet feeder to the sheet-fed rotary press. The remaining-stack device has a closed frame on which there are arranged non-stop bars, which can be driven as piston rods of individual cylinders by means of a pressure medium, and which are drivable into grooves of a pallet carrying a sheet stack. The non-stop bars lie, in the driven-in state, on both sides of the frame and are to be removed successively from the zone of the sheet feeder. While the rods have individual drive cylinders, the patent discloses nothing about the sequence of operation. The bridging of the gap conditioned by the non-stop bars between main stack and remaining stack is, an obstacle for a faultless continuous processing in the unification of the stacks.

From DE 4203500 A1 a sheet feeder is known. It presents, parallel to the sheet feeder and allocated to this on face side, an auxiliary-stack carrying device as an independent component. Then, over a common drive individually drivable pointed bars are provided which can be introduced into grooves of a pallet carrying a sheet stack. The drive has individual chain gears which are couplable onto the respective pointed bars. For the guidance and accessibility of the chain gears special constructive measures are required. The chain gears completely block the space in front of the sheet feeder, so that this latter is not accessible.

In the stack change it is provided, in the joining of main stack and remaining stack, to remove the pointed bars out of the stack zone, first on the outside, then in the middle and last of all in the zone between the already pulled pointed bars, so that a gentle depositing of the remaining stack on the sheet stack results. This is possible, however, with the requisite precision, only in the case of heavy materials such as sheets made of metal.

Finally, from DE 19520772 C1 there is known a non-stop sheet feeder for printing presses with fork bars movable in and out. In this feeder, on both sides of the stack zone, there are provided units of fork bars movable on both sides of the stack zone transversely to the sheet transport direction. The fork bars are connected with one another and drivable in common into grooves of a pallet carrying a sheet stack. From there they can take over an auxiliary stack in order to bridge the time period up to the supplying of a new sheet stack. For the preliminary approach of the main stack and of the remaining stack before the final joining, the fork bars are rectangular in cross section and turnable about a longitudinal axis. There the fork bars are thrust in first in the upright orientation, in order to be able to carry as great a load as possible. For the approach they are then rotated through 90 degrees, so that the main stack and the remaining stack approach the value of the thickness of the narrower side to each other. In the turning of the fork rods measures have to be taken in order to avoid a shifting of the fork bars. This has proved in practice to be virtually unfeasible.

Further there is known from DAS 1095297 a sheet feeder with several stack-lifting mechanisms. It has a fork-shaped remaining-stack carrying device which is provided with remaining-stack bars slidable into grooves of a pallet. The device makes possible the take-over of a remaining of a sheet stack from the pallet for the continuous feeding of the sheets while a new sheet stack is installed into the sheet feeder. The remaining-stack device is connected with a separate lifting mechanism parallel to the main-stack lifting mechanism inside the sheet feeder, so that the remaining stack is continuously liftable. The operating range of the remaining-stack carrying device is restricted. The remaining-stack carrying device hampers the access to the sheet feeder.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which allows for simple and continuous stack changing with undisturbed sheet transport and no wasted paper.

The present invention provides these and other advantages and overcomes the drawbacks of the prior art by providing a stack changing device which utilizes an improved method and device for receiving a remaining-stack and transferring the remaining stack to a newly fed-in sheet stack.

It is advantageous that carrying and spacing bars, independent from one another, are provided in the device, which are pulled, not simultaneously but intermittently, out of the stack zone for the unburdening of the sheet material. There preferably can be provided a different height for the two types of bars, which produces a smooth depositing movement of the stack remaining on the sheet stack.

In particular the continuous removal of the remaining stack bars from the inside outward and in two stages makes possible a gentle depositing of the remaining stack on the sheet stack. Preferably, a speed profile should be maintained for influencing the stack approach, in the pulling speeds between the individual bars.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

Figure 1:
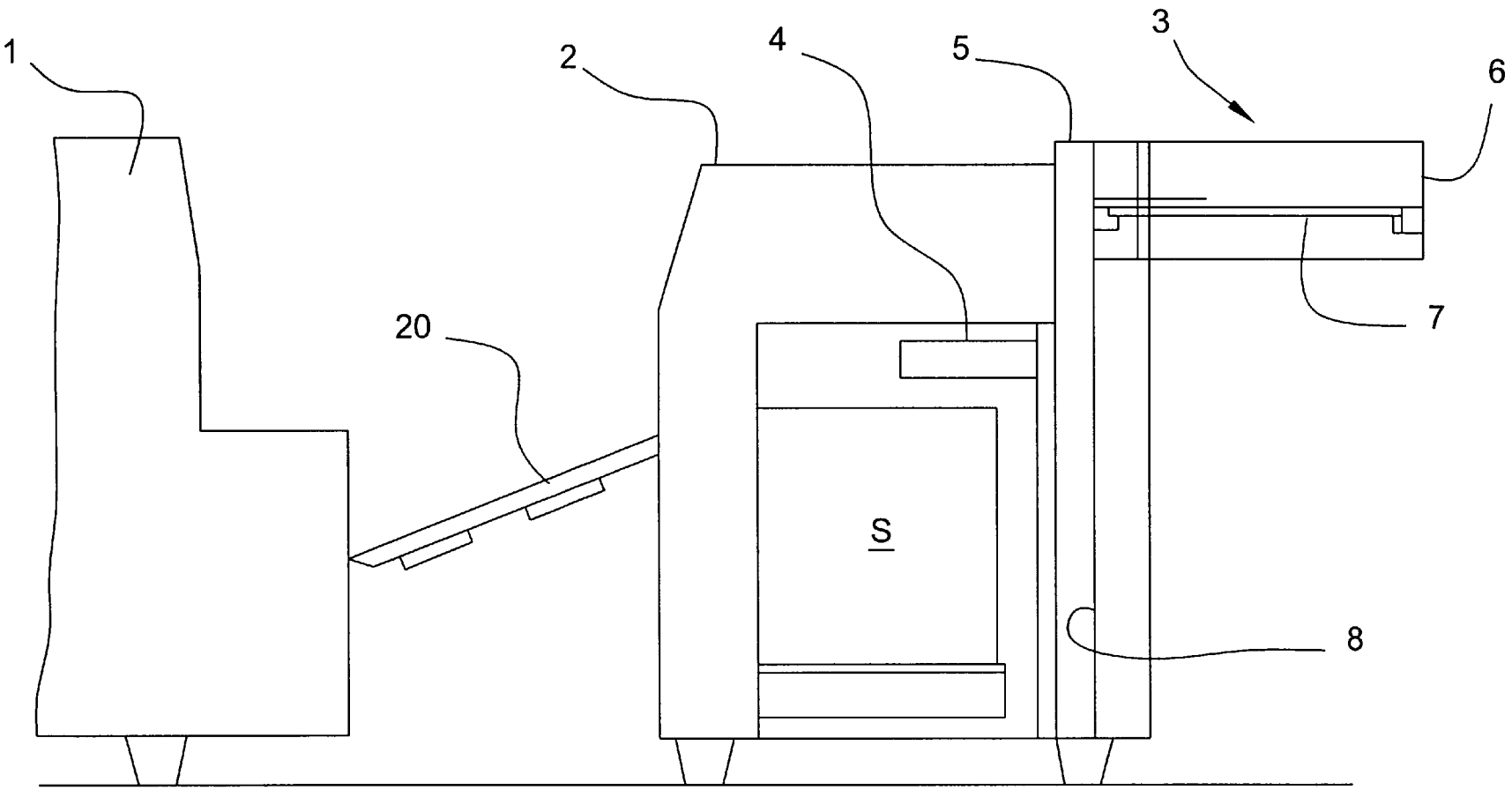
FIG. 1 is a side elevation view of an illustrative embodiment of a sheet feeder constructed in accordance with the present invention.

In FIG. 1, a sheet feeder 2 is represented connected with a sheet-processing machine, for example with a sheet printing press 1. In the sheet feeder 2 there is used a sheet stack S is used for processing. The sheet stack can be raised by means of a main stack lifting device, which is not represented in detail here, in the rhythm of the sheet processing. The sheets of the sheet stack S are taken one-by-one or singled from its upper side and fed to the sheet-fed printing press 1 as a sheet stream. In the sheet feeder 2 there is provided a sheet-singling arrangement 4, which is provided with a whole number of multiple operating elements for format-dependent adjustments and for adjustment of the supply system with either suction or blast air. The operating elements serve for the attuning of the different functions of the sheet-singling device 4 to the proper transport of the sheets from the sheet feeder 2 to the sheet-fed printing press 1. In the sheet feeder 2, there is further provided a remaining-stack carrying device 3, which is allocated to the face side away from the sheet-fed printing press 1 of the sheet feeder 2. The remaining-stack carrying device 3 is provided with a frame or frame 6, in which the remaining stack bars 7 are borne longitudinally slidably. By means of the frame 6, the remaining-stack carrying device 3 is suspended on a lifting device 5. The lifting device 5 is indicated here only in its position, not, however, in detail. The lifting device 5 serves to hold an auxiliary stack in the sheet feeder 2 and to raise it in the rhythm of the sheet processing. For this reason the lifting device 5 is also controllable synchronously with the main stack-lifting device. The lifting device 5 consists of vertical guide bars 8 connected with the sheet feeder 2, on which (rails) the frame 6 is guided, and has, for example, lift chains, by means of which the remaining-stack carrying device 3 is raisable or lowerable.

Figure 2:
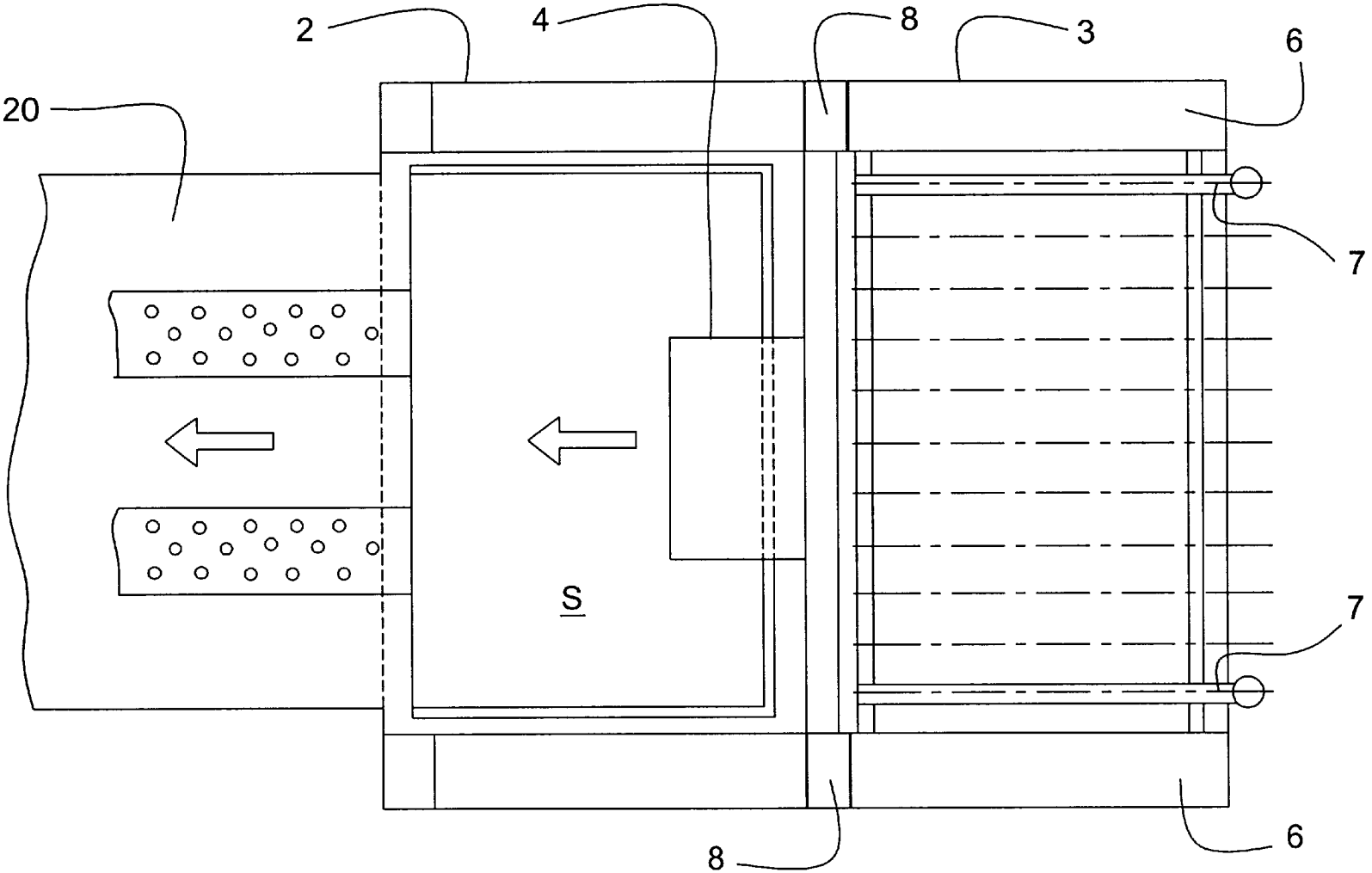
FIG. 2 is a plan view of a sheet feeder.

In FIG. 2 the sheet feeder 2 is shown in a top view. Upon the sheet feeder 2 there follows, in the sheet running direction indicated by arrows, a so-called band table 20, over which the sheet stream generated by the singling, is transported to a sheet-processing machine, for example the printing press 1. Further, the position of the sheet-singling device 4 is recognizable in allocation to the rear edge of the sheet stack S.

The orientation of the remaining-stack bars 7 is represented in its arrangement in respect to the sheet feeder 2, only the two outer remaining-stack bars 7 being represented, and the others being indicated with their effect lines. The position shown is, for example, the readiness position before the onset of a changing process or the waiting position outside of the operating range of the sheet feeder 2. The remaining-stack bars 7 are guided there inside the remaining-stack carrying device 3, so that in the position shown they occupy a horizontal position outside the range of the sheet feeder 2. The remaining-stack carrying device 3 with its frame 16 is guided by means of the guide on the sheet feeder 2 and is vertically movable. The lifting device 5 is again indicated only in its position and is located on the upper side of the guide bars 8, for example on the frame of the sheet feeder 2, engages from there on the frame 6 of the remaining-stack carrying device 3 and moves this stack upward and downward on the guide bars (or rails) 8.

Figure 3:
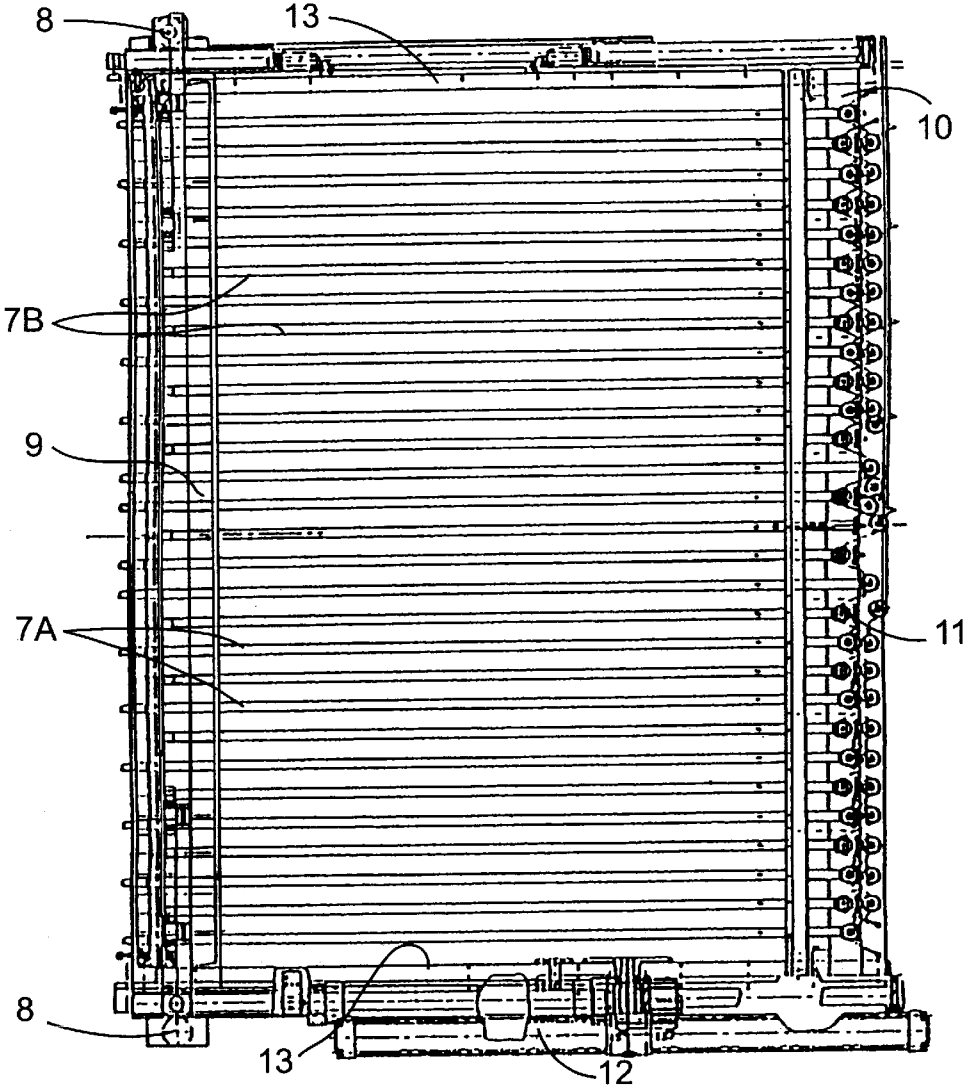
FIG. 3 is plan view of a stack-changing device of the sheet feeder.
Figure 3:
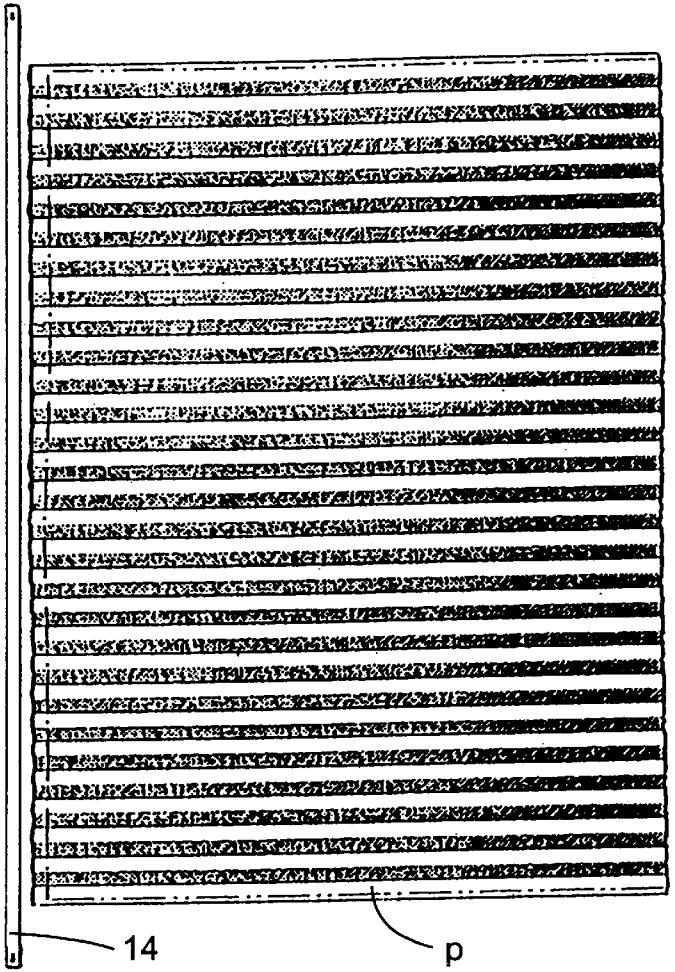

In FIG. 3, there is shown a complete representation of the remaining-stack carrying device 3. The frame 6 is guided vertically on the guide bars 8. In the frame 6, in a front carrying rail 9 there are guided the remaining stack bars 7 in the form of carrying bars 7A and spacer bars 7B. On a rear carrying bar 10 there is arranged a pull-drive 11 for singled pulling of the carrying bars 7A and spacing bars 7B. It will be appreciated by one skilled in the art that various known pulling drives may be used for individually pulling the carrying bars 7A and spacing bars 7B, including gear drive chains such as shown in the above-referenced DE 4203 500 A1 or individual drive cylinders, such as shown in the above-referenced DE 39 171 0 C. Moreover, as will become apparent herein, such known drives may be operated to simultaneously pull more than one carrying bar 7A or spacing bar 7B at a time.

In FIG. 3, the carrying bar 7A and spacing bar 7B are shown in the waiting position. Further, there are provided on both sides, drives 12 for the longitudinal shifting of the rear carrying rail 10 on guide rails 13 on the frame 6. The drives 12 determine the position of the rear carrying rail 10 at the rear end of, or within, the frame 6. The front carrying rail 9 is firmly joined with the frame 6. The carrying bars 7A and the spacing bars 7B are of different height. The carrying bars 7A are, for example, about twice as high as the spacing bars 7B. By height there is meant the extension of the carrying bars 7A or spacing bars 7B perpendicularly to the extended plane of the remaining-stack carrying device 3. The effect of this measure will be thoroughly shown in the following representations.

The carrying bars 7A and spacing bars 7B can be of equal length. In a preferred form of execution the carrying bars 7A, however, are longer than the spacing bars 7B. The carrying bars 7A serve in the taking-over of a remaining stack H first of all for the load reception and are to be dimensioned correspondingly, in which system the load is to be led off into a further carrying means (see FIG. 4).

Figure 4:
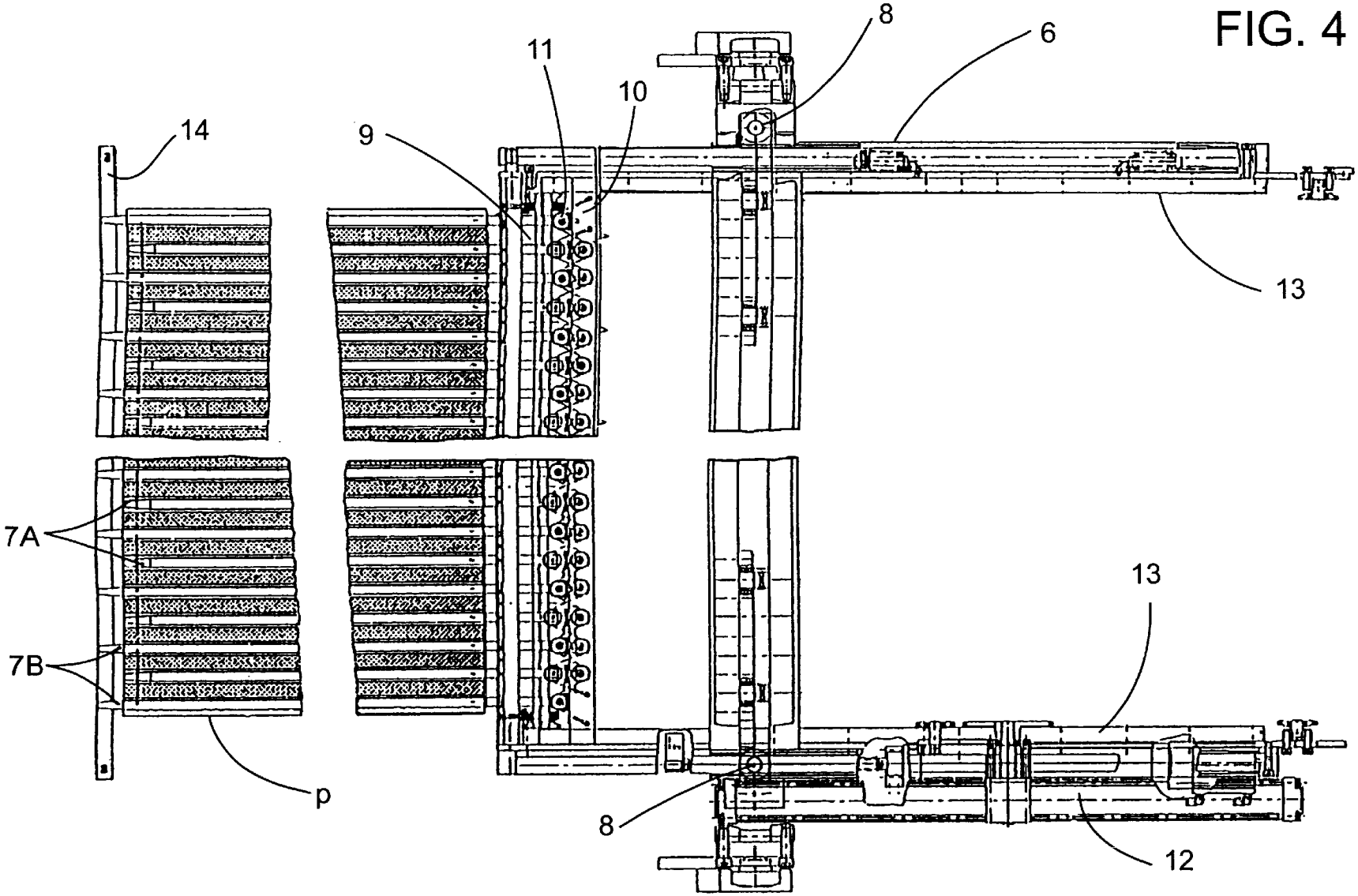
FIG. 4 is a plan view showing the stack-changing device of FIG. 3 taking over a remaining stack.

In FIG. 4, the remaining-stack carrying device 3 is shown in operation. The carrying bars 7A, as well as the spacing bars 7B are shifted by means of the drives 12 together with the rear carrying rail 10 with respect to the front carrying rail 9 and introduced into grooves of a pallet carrying the sheet stack S. Front carrying rail 9 and rear carrying rail 10 with the pulling drive 11 now lie parallel in front of the pallet P, which carries a remaining of the sheet stack S, the so-called remaining-stack H. The pallet P and the remaining stack H are not touched there by the front carrying rail 9. The longer and higher carrying bars 7A lie on a remaining-stack lifting rail 14 on the front end (as seen in the sheet running direction) in the sheet feeder 2. This remaining-stack lifting rail 14 is coupled with a lifting drive and provided for the support of the carrying bars 7A as well as their lifting movement during production. The remaining-stack lifting rail 14 and the lifting device 5 are, for this purpose, both joined with the remaining stack-lifting device of the sheet feeder 2 or at least mechanically or controllably coupled with one another so that in the stack processing, but especially in the bringing together of the remaining stack H with a new sheet stack S, they can be synchronously lifted.

Figure 5:
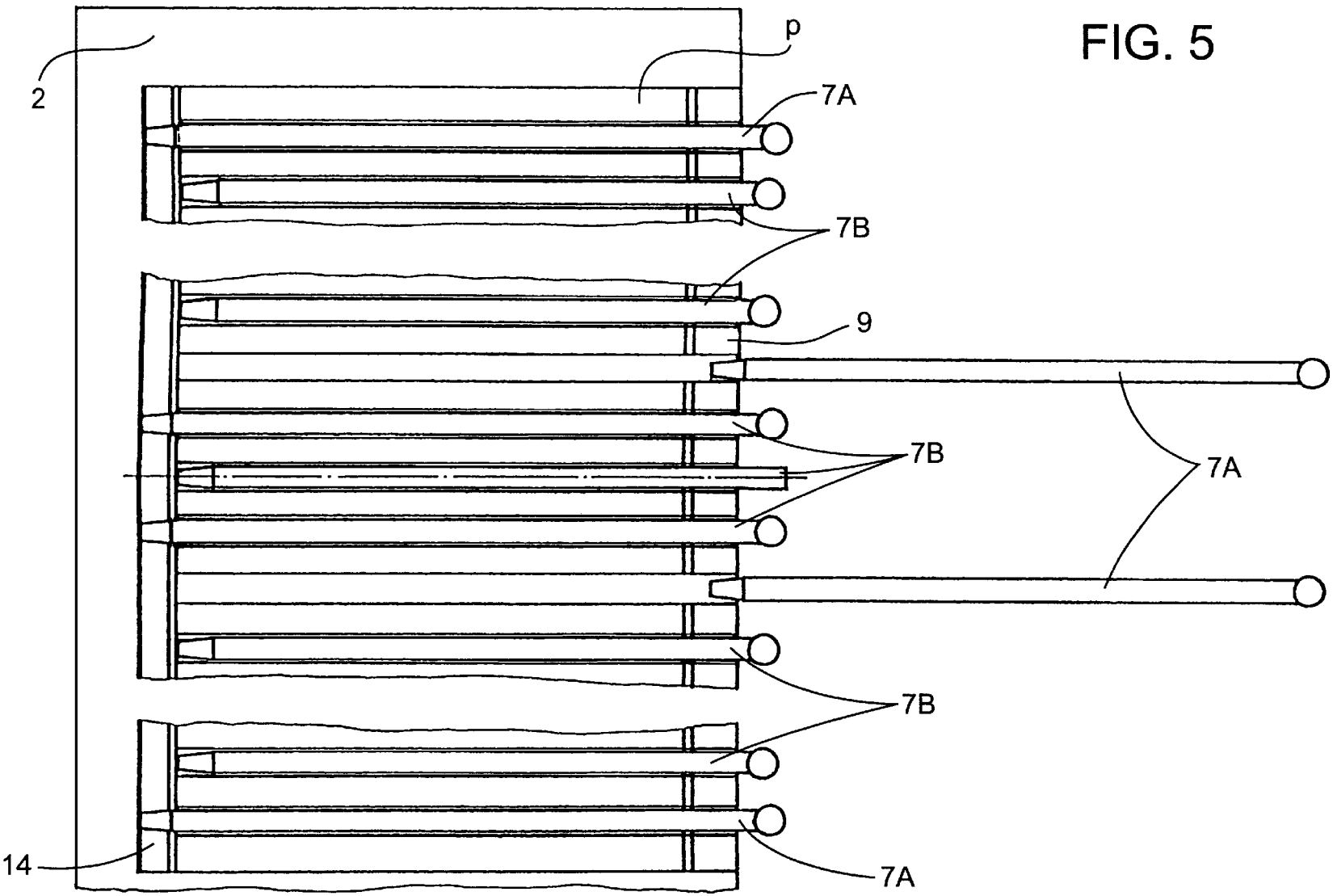
FIG. 5 is an enlarged partial plan view showing the stack-changing device during the stack change.

In FIG. 5, there is explained once again the connection of the pulling movement to the arrangement inside the sheet feeder 2. The carrying bars 7A and the spacing bars 7B lie alternately in grooves of a pallet P (in which context one must imagine oneself as lying on the webs between the grooves of the pallet perpendicular to the sheet stack S). The carrying bars 7A lie there on the remaining stack-lifting rail 14. The same holds in the illustrated case for the inner spacing bars 7B, which have only half the height of the carrying bars 7A. The pulling process of the carrying bars 7A begins with the thicker carrying bars 7A lying closest to the stack middle, which, as shown, are pulled as a pair. There the auxiliary stack H in this zone comes to lie slowly on the thinner spacing bars 7B. The pulling of the thicker carrying bars 7A and, in sequence, of the thinner spacing bars 7B occurs smoothly, and in close time sequence, but always separately from one another. For this there is provided a device for controlling the pulling movement. This can be integrated directly into the pulling drive 11 for the carrying bars 7A or spacing bars 7B or can act over further a controllable pulling drive of each individual carrying bar 7A or spacing bar 7B. What is essential is that in the pulling of the remaining-stack bars 7 in each case the inner remaining-stack bars 7 are pulled with an altogether lower speed than the outer remaining-stack bars 7. This holds both for the carrying bars 7A and also for the spacing bars 7B. Therewith it is ensured that at the time point of the removal of the remaining-stack bars and in the zone of the middle, i.e. when the remaining stack H begins to sink, there is yielded only a slow lowering on the stack surface. Therewith the remaining stack H can easily be made to follow in reference to the singling arrangement and the transfer position to the band table 20.

The speed of the inner remaining-stack bars 7 can be removed, for example, by half with respect to the outer remaining-stack bars 7. Likewise, the speed of the remaining stack bars 7 from inside outward can be made continuously rising.

In a further form of execution of the process it can be provided to vary starting time points of the pulling movement of the individual remaining-stack bars 7. Here, for example, the inner remaining stack bars 7 can be pulled slowly in order to make possible the adaptation processes in the sheet singling and in the transfer of the sheets at the stack front edge onto the band table. Since, however, a delaying of the total changing operation is produced, the pulling movement of the further remaining-stack bars with higher speed can set in already before the slow remaining-stack bars 7 in the middle are completely pulled. There, however, the principle of the complete removal of the remaining-stack bars 7 should not be violated. The variant of the offset onset of the pulling movement can be applied, in dependence on the quality of the sheets, also to the movement from remaining-stack bar 7 to remaining stack bar 7. Therewith, a further reduction of the time for the stack change is produced with simultaneous maintenance of a good stack quality.

The drives of the remaining-stack bars 7 are to be designed in such a way that the speed in the pulling process is variable from bar to bar. This is possible preferably by individual drive devices of the remaining stack bars 7. Also possible, however, is a common drive device for all the remaining-stack bars 7, which drive, however, depending on construction, is coupleable onto the particular carrying bar 7A or spacing bar 7B, or is successively released from one after another in the movement of the particular carrying bars 7A or spacing bars 7B.

The stack change proceeds, therefore, as follows:

I.—On reaching a minimum height of the sheet stack S the stack change process is started.

II.—The carrying bars 7A and the spacing bars 7B are thrust in common from the frame 6 into the grooves of the pallet P underneath the sheet stack S, in which process the sheet stack S remains free on the rear side to the remaining-stack carrying device 3.

III.—The carrying bars 7A are undercut by the remaining-stack lifting rail and lifted until the remaining stack H is carried by the carrying bars 7A.

IV.—The pallet P is lowered and removed from the sheet feeder 2.

V.—The remaining stack H is further raised continuously by means of the auxiliary stack drive for the singling of the sheets.

VI.—A new sheet stack S is installed in the sheet feeder 2 and is lifted by means of the main stack-lifting device.

VII.—On contacting of the upper side of the sheet stack S with the underside of the carrying bars 7A the pulling operation of the carrying bars 7A is initiated.

VIII.—The inner carrying bars 7A are drawn out at a first speed between remaining stack H and sheet stack S.

IX.—The following further outside-lying carrying bars 7A are drawn out at a second, greater speed between remaining stack H and sheet stack S.

X.—The remaining stack H comes to lie from inside outwards continuously on the spacing bars 7B.

XI.—The remaining-stack lifting rail becomes free, the remaining-stack carrying device 3 no longer takes on any load, the remaining spacing bars 7B still have only a control function for the unification of the stack.

XII.—The inner spacing bars 7B are pulled out at a first speed between remaining stack H and sheet stack S.

XIII.—The following further out-side lying spacing bars 7B are drawn out at a second, greater speed between remaining stack H and sheet stack S.

XIV.—The remaining stack H comes to lie from inside outward continuously on the upper side of the sheet stack S.

XV.—The stack change is completed.

The entire run-off has the advantage that the remaining stack H continuously approaches the sheet stack S, so that no jump points arise in the removing of the remaining-stack bars 7, which have a troublesome effect on the sheet singling, or the moving of the sheets out of the sheet feeder 2 onto the band table 20 or could even interrupt the operating run-off. This holds first of all for the steady follow-up of the upper side of the stack opposite the sheet singling arrangement, where a spacing is to be maintained within a tolerance range. Further this holds for the moving out of sheets after the singling, since on the front edge of the sheet stack S or remaining-stack H control means, for example a so-called sheet flap is provided, which frees the sheet course to the band table 20 or blocks said sheet course. Here, to a determined height, tolerance is to be maintained, so that the front edge of the sheet does not strike in moving out through the thrusting movement from the rear edge of the sheet and is therewith upset.

In a further form of execution, it can be provided that there is no use at all of the remaining-stack bars 7. Thus, in the case of very thick sheet materials, which in consequence of their stability sink only slowly into the enlarging interspace in the gap between sheet stack S and remaining stack H, the spacing bars 7B can be omitted. Thereby the changing process is accelerated, since time is saved for the pulling of the spacing bars 7B. Likewise, in the middle of the stack, carrying bars 7A can be omitted in pairs, so that the auxiliary stack H there immediately descends onto the spacing bars 7B. The adapting process to the stack surface in respect to the singling device can be supported by at first slow lowering of the pallet P. For these measures the corresponding remaining-stack bars do not have to be removed. It suffices for this to uncouple or to block the corresponding drive means. These remaining-stack bars 7 will not be driven into the grooves of the pallet P before the stack change.

Above all, also for the last-mentioned cases of application, the pulling movement of the individual remaining-stack bars with different speeds is very important in order to assure the continuous run-off of the sheet singling.

What is claimed is:

1. A process for automatically and continuously changing a sheet stack in a sheet feeder of a sheet-processing machine including a remaining-stack carrying device having remaining-stack bars, the sheet stack having a pair of opposing stack edges and a middle area interposed between the opposing stack edges, the stack changing process comprising the steps of:

temporarily receiving a remaining stack from a pallet on the remaining-stack bars by sliding the remaining-stack bars underneath said remaining stack from a common side of the stack, continuously raising said remaining stack with the remaining-stack bars, and depositing said remaining stack on a newly fed-in sheet stack which has been moved into position below said remaining stack by removing the remaining-stack bars from underneath the remaining stack with the remaining-stack bars underneath the middle area of the remaining stack being pulled at a speed different than the speed at which the remaining-stack bars underneath the opposed edges of the remaining stack are pulled from underneath the remaining stack.

2. The process of claim 1 including sequentially removing said remaining stack bars from the stack starting with at least one of the remaining stack bars in the middle area of the sheet stack and then progressively removing other of the remaining stack bars progressively outwardly to the remaining stack bars adjacent the opposing stack edges.

3. The process of claim 1 including removing the remaining stack bars in the middle of the stack at a speed less than the speed at which the remaining stack bars toward the stack edges are removed.

4. The stack changing process according to claim 1 wherein the pulling speed of the remaining-stack bars underneath the middle area of the stack equals approximately half of the pulling speed of the remaining-stack bars underneath the stack edges.

5. The stack changing process according to claim 1 wherein the pulling speed of the remaining-stack bars increases in a continuous manner from the remaining-stack bars underneath the middle area of the remaining stack to the remaining-stack bars arranged underneath the stack edges.

6. The process of claim 1 including removing said stack bars from said stack in pairs.

7. The stack changing process according to claim 6 wherein the pulling of a pair of remaining-stack bars is initiated only after a previously pulled pair of remaining-stack bars has been completely pulled out of the stack.

8. The stack changing process according to claim 6 wherein the respective pulling speed of each of the remaining-stack bars remains substantially constant as they are pulled out from underneath the remaining stack.

9. The stack changing process according to claim 6 wherein the start of the pulling of each pair of remaining-stack bars underneath the edges of the stack is initiated before pairs of remaining-stack bars underneath the middle of the stack have been completely pulled out of the stack.

10. A process for automatically and continuously changing a sheet stack in a sheet feeder of a sheet-processing machine including a remaining-stack carrying device having remaining-stack bars, the sheet stack having a pair of opposing side edges and a middle area interposed between the opposing side edges, the stack changing process comprising the steps of:

temporarily receiving a remaining stack on the remaining-stack bars from a pallet by sliding the remaining-stack bars underneath said remaining stack from a common side of the stack with said remaining stack resting on a first portion of the remaining-stack bars in a position above a second portion of the remaining-stack bars;

continuously raising said remaining stack with the remaining-stack bars; and depositing said remaining stack on a newly fed-in sheet stack which has been moved into position below said remaining stack by sequentially removing the remaining-stack bars from underneath the remaining stack, the sequentially removing step including:

individually and progressively pulling out a first set of remaining-stack bars before a second set of remaining-stack bars by initially pulling out the remaining-stack bars underneath the middle area of the sheet stack and thereafter pulling out the remaining-stack bars underneath the side edges of the sheet stack such that said remaining stack is deposited on the second portion of the remaining-stack bars before the remaining stack is joined with the newly fed-in sheet stack, the remaining-stack bars underneath the middle area of the stack being pulled at a speed that is less than the speed at which the remaining-stack bars underneath the side edges are being pulled;

individually and progressively pulling the second set of remaining-stack bars by initially pulling out the remaining-stack bars underneath the middle area of the sheet stack and thereafter pulling out the remaining-stack bars underneath the side edges of the sheet stack, the remaining-stack bars underneath the middle area of the stack being pulled at a speed that is less than the speed at which the remaining-stack bars underneath the side edges are being pulled.

11. The stack changing process according to claim 10 wherein the pulling of individual remaining-stack bars is initiated only after the previously pulled remaining-stack bars have been completely pulled out of the stack position.

12. The stack changing process according to claim 10 wherein the respective pulling speed of each of the remaining-stack bars remains substantially constant as it is pulled out of the stack position.

13. The stack changing process claim 10 wherein the start of the pulling of individual remaining-stack bars underneath the edges of the stack is initiated before remaining-stack bars underneath the middle area of the stack have been completely pulled out from underneath the stack.

14. The stack changing process according to claim 10 wherein the pulling speed of the remaining-stack bars underneath the middle area of the stack equals approximately half of the pulling speed of the remaining-stack bars underneath the side edges.

15. The stack changing process according to claim 10 wherein the pulling speed of the remaining-stack bars increases in a continuous manner from the remaining-stack bars underneath the middle area of the sheet stack to the remaining-stack bars underneath the side edges.

16. A device for changing a sheet stack in a sheet feeder of a sheet processing machine, the sheet stack having two opposing edges and a middle area interposed between the edges, the stack changing device comprising:

a main stack lifting mechanism for raising and lowering of a sheet stack, a remaining-stack carrying device including remaining-stack bars for temporarily receiving a remaining stack and transferring said remaining stack to a newly fed-in sheet stack, wherein the remaining-stack bars comprise carrying bars and spacing bars with each of the spacing bars having a thickness which is less than the thickness of the carrying bars, a drive mechanism for slidably moving the remaining-stack bars longitudinally into a stack position from a common side of the stack such that some of said stack bars are positioned underneath the middle area of the remaining stack and some of said stack bars are positioned underneath opposing edges of the remaining stack, said drive mechanism being operable for removing the remaining stack bars arranged underneath the middle area of the stack at a slower speed than the remaining stack bars underneath opposing edges of the stack, and a remaining-stack lifting mechanism for raising the remaining-stack carrying device.

17. The stack changing device of claim 16 in which said drive mechanism is operable for sequentially removing the remaining sheet stack bars from the stack starting with the remaining stack bars in the middle area of the sheet stack and then progressively removing the other stack bars progressing outwardly to the stack bars located adjacent the opposing edges of the stack.

18. A device for changing a sheet stack in a sheet feeder of a sheet processing machine, the sheet stack having two opposing edges and a middle area interposed between the edges, the stack changing device comprising:

a main stack lifting mechanism for raising and lowering of a sheet stack, a remaining-stack carrying device including remaining-stack bars for temporarily receiving a remaining stack and transferring said remaining stack to a newly fed-in sheet stack, wherein the remaining-stack bars have different relative thicknesses, a drive mechanism for slidably moving the remaining-stack bars longitudinally into a stack position from a common side of the stack and sequentially retracting the remaining-stack bars from the stack position, the drive mechanism being operable for removing the remaining-stack bars arranged underneath the middle area of the stack at a slower speed than the remaining-stack bars arranged underneath the edges of the stack, and a remaining-stack lifting mechanism for raising the remaining-stack carrying device.

* * * * *